United States Patent [19]

Fisher

[11] Patent Number: 4,732,105

[45] Date of Patent: Mar. 22, 1988

[54] BOAT ANCHOR

[76] Inventor: Roger Fisher, Rte. 2, Box 108, Stanley, N.C. 28164

[21] Appl. No.: 935,757

[22] Filed: Nov. 28, 1986

[51] Int. Cl.[4] ..... B63B 21/34

[52] U.S. Cl. ..... 114/301; 114/294

[58] Field of Search ..... 114/293, 294, 297, 299, 114/300, 301, 302, 303; D12/215; 52/155, 158

[56] References Cited

U.S. PATENT DOCUMENTS

| | | | |
|---|---|---|---|
| 42,346 | 4/1964 | Chamberlain | 114/301 |
| 180,374 | 7/1976 | Robinson | 114/299 |
| 1,139,202 | 5/1915 | Masak | 114/301 |
| 1,325,693 | 11/1919 | Deam | 114/303 |
| 1,983,481 | 12/1934 | Mortensen | 114/301 |
| 2,056,439 | 10/1936 | Welles | 114/298 |
| 2,103,477 | 12/1937 | Lucking | 114/301 |
| 2,161,906 | 6/1939 | Filby | 114/301 |
| 2,591,236 | 4/1952 | Christie | 114/298 |
| 2,735,394 | 2/1956 | Walpole | 114/294 |
| 3,777,695 | 12/1973 | Bruce | 114/301 |
| 4,173,938 | 11/1979 | Colin | 114/294 X |
| 4,337,717 | 7/1982 | Gregory | 114/294 |
| 4,523,539 | 6/1985 | Granger | 114/299 |
| 4,577,581 | 3/1986 | Puech | 14/294 |

FOREIGN PATENT DOCUMENTS

| | | | |
|---|---|---|---|
| 1509524 | 5/1978 | United Kingdom | 114/301 |

*Primary Examiner*—Sherman D. Basinger
*Assistant Examiner*—Paul E. Salmon
*Attorney, Agent, or Firm*—W. Thad Adams, III

[57] ABSTRACT

A boat anchor (10) includes three runners (11, 12, 13) having respective rear spikes (18, 19, 20) and front spikes (22, 23) for penetrating bottom material such as hard sand or mud. A bail (30) rolls the anchor onto the hooks. Flukes (32–36) are positioned on the runners (11, 12, 13) and induce drag through the bottom material which limits the movement of the anchor.

11 Claims, 5 Drawing Figures

BOAT ANCHOR

TECHNICAL FIELD AND BACKGROUND OF THE INVENTION

This invention relates to a boat anchor particularly designed for holding in sand and mud. The anchor has particular utility for anchoring relatively small boats in areas where the current is relatively swift and the bottom either comprises hard, scoured sand, such as in a salt-water inlets, or where the bottom comprises mud. Ideally, an anchor such as the one described above should be relatively lightweight, inexpensive, resistent to fouling and nevertheless easy to release if fouling does occur. An anchor having all of these characteristics and nevertheless particularly useful in hard sand and mud has not previously been developed.

SUMMARY OF THE INVENTION

Therefore, it is an object of the invention to provide an anchor for holding in sand and mud.

It is another object of the invention to provide an anchor which is lightweight, easy to manufacture, resistent to fouling and easy to release if fouling does occur.

These and other objects of the present invention are achieved in the preferred embodiment disclosed below by providing a boat anchor having first and second elongate, longitudinally extending runners. One end of each of the runners defines an acutely angled rear hook and the other end of each of the runners defines an obtusely angled front hook. Substantially translation movement of the runners relative to the bottom drives the front and rear hooks into the bottom material.

The runners are secured together by means of at least one transversely extending tie bar to which the first and second runners are secured in spaced-apart registration with each other. Rings are provided on both ends of the anchor, each ring adapted to receive a separate line.

Preferably, the anchor according to the invention includes at least three runners connected together by a plurality of spaced-apart tie bars.

According to the preferred embodiment of the invention, the anchor also includes a bail. The bail comprises an arcuate substantially semicircular bar having opposing ends attached to opposite side of the anchor. In case the anchor should fall to the bottom with the hooks pointing upwardly, the downwardly extending bail will cause the anchor to roll over into an orientation where the hooks are directed downwardly into the bottom material.

According to the preferred embodiment of the invention disclosed in this application, flukes are positioned on the front and rear of each of the runners. A fluke is positioned in the concavity of each of the acutely angled rear hooks of the runners and another fluke is positioned on the upper surface of each of the obtusely angled hooks of the runners. The flukes act as drag resisting plates and include a flat surface transverse to the runner for presenting the flat surface side in the direction of anchor movement to resist movement of the anchor through the bottom material.

BRIEF DESCRIPTION OF THE DRAWINGS

Some of the objects of the invention have been set forth above. Other objects and advantages of the invention will appear as the description of the invention proceeds when taken in conjunction with the following drawings, in which.

DESCRIPTION OF THE PREFERRED EMBODIMENT

Figure 1:
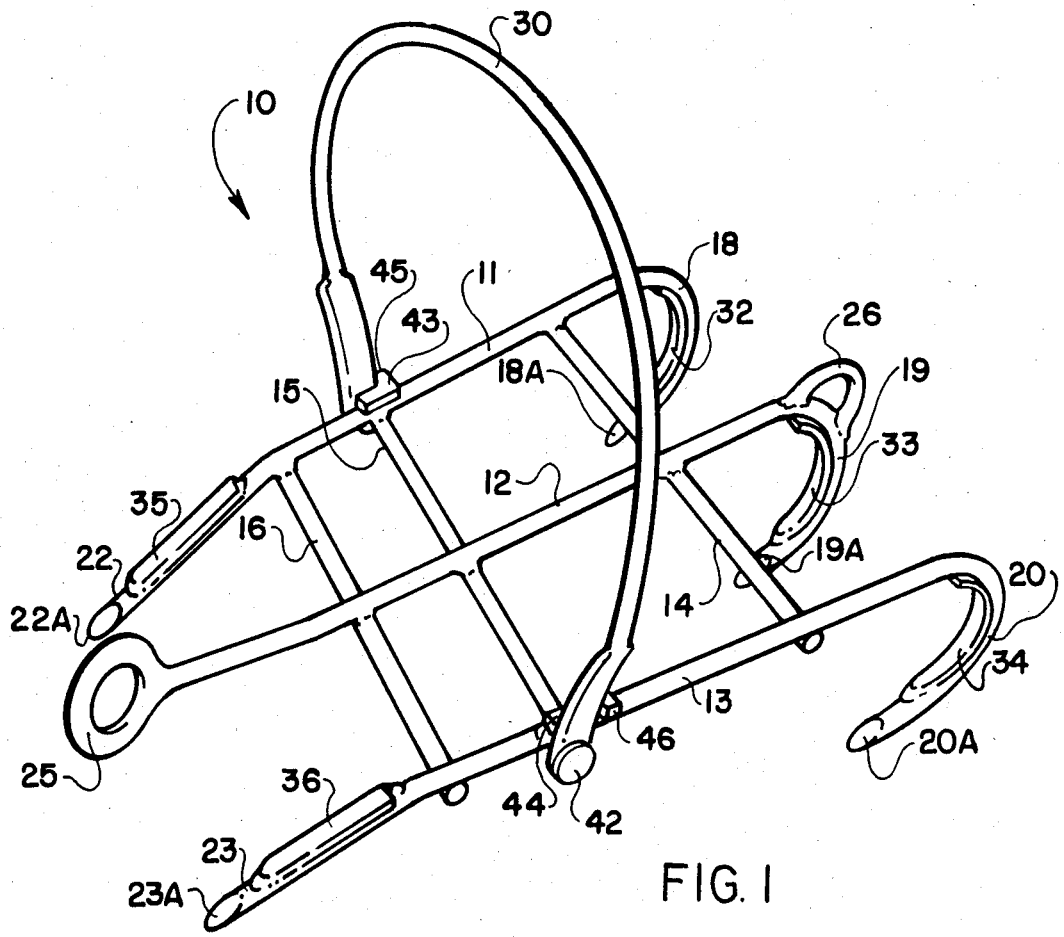
FIG. 1 is a perspective view of an anchor according to a preferred embodiment of the invention.

Referring now to FIG. 1, an anchor according to the present invention is shown and generally designated at reference numeral 10. Anchor 10 comprises three elongate, longitudinally extending runners 11, 12 and 13 attached in registration with each other by means of transversely extending tie bars 14, 15 and 16 to which runners 11, 12 and 13 are welded. The rear end of runners 11, 12 and 13 define acutely angled hooks or spikes 18, 19 and 20, respectively. The end of hooks 18, 19 and 20 are cut at an acute angle to present a sharpened point 18A, 19A and 20A. This assists in driving the anchor into hard-packed sand.

The front of runners 11 and 13 comprise obtusely angled hooks or spikes 22 and 23, the respective ends of which are also cut at an acute angle to define points 22A and 23A, respectively. The front end of runner 12 defines a ring 25 to which an anchor line can be attached. On the rear end of runner 12 a ring 26 is formed by welding a U-shaped member to the convex surface of hook 19.

Figure 3:
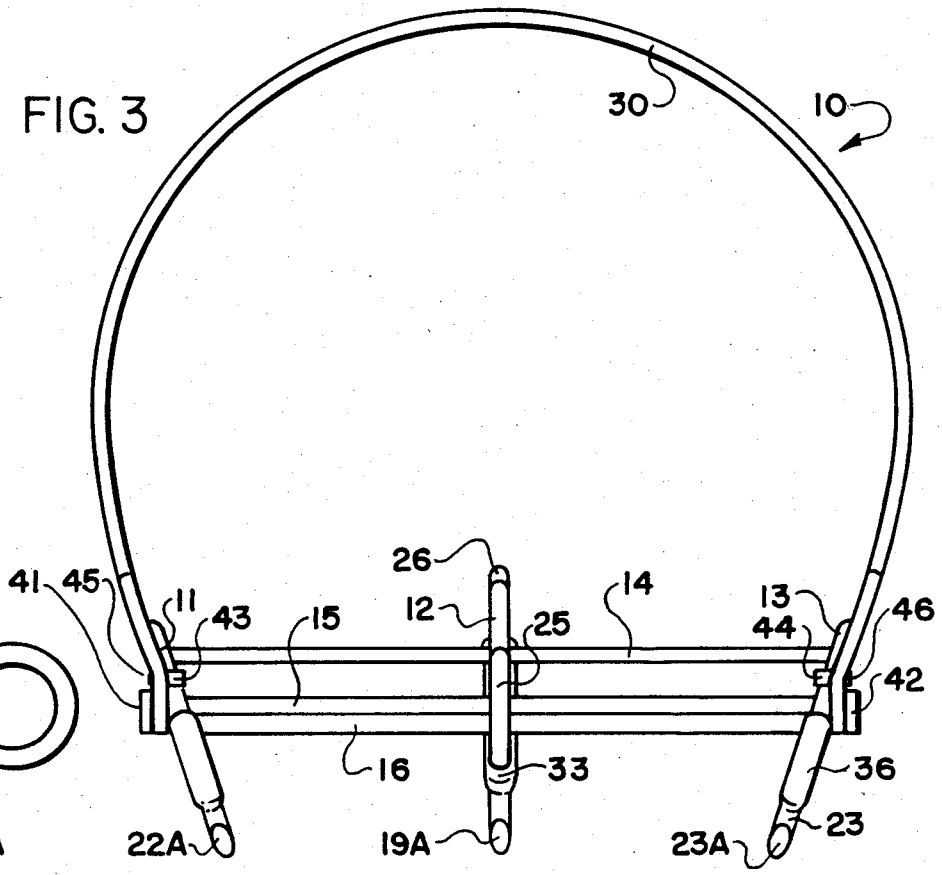
FIG. 3 is an end elevational view, as viewed from the front end.
Figure 2:
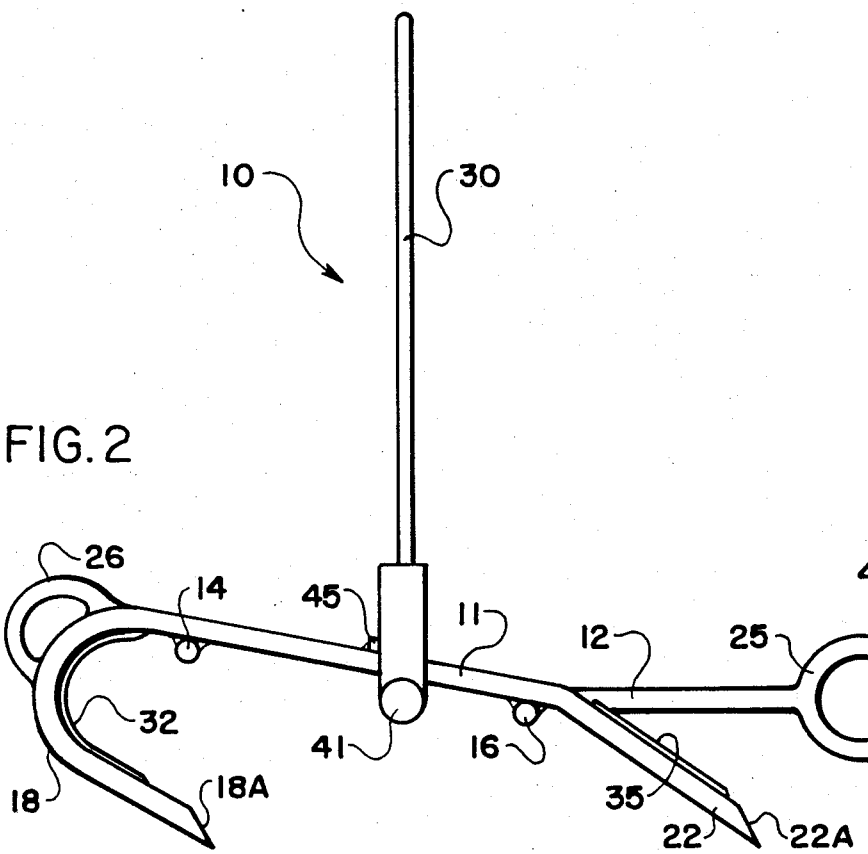
FIG. 2 is a side elevational view of the anchor shown in FIG. 1.

Since neither end of anchor 10 is substantially heavier than the other, it is possible for the anchor 10 to fall onto the bottom with the points 18–20A and 22A and 23A pointed upwardly. In order to orient anchor 10 correctly, a bail 30 is pivotally mounted to opposite ends of tie bar 15. Bail 30 is secured to anchor 10 with a relatively tight press fit which is sufficient to keep bail 30 in the position to which it is fixed but also to permit the bail 30 to be lowered to a position substantially flush with the top of runners 11, 12 and 13, and ring 25 if desired, such as when stowing the anchor after use. Bail 30 is mounted on opposite ends of tie bar 15 and held by enlarged rivit heads 41, 42 (See FIG. 3). Brackets 43, 44 mounted on runners 11 and 13, respectively, have outwardly projecting heads 45, 46 which prevent rearward movement of bail 30. With bail 30 in the position shown in each of the figures, should anchor 10 fall to the bottom with bail 30 in a downwardly extending direction, the relatively large curve which the bail 30 defines will cause the anchor to roll over into the correct position. The shape of the bail 30 is best shown in FIG. 3. Note that bail 30 at its greatest diameter is substantially wider than that portion of the anchor defined by runners 11 and 13. Note also that the angle of inward tilt of runners 11 and 13 follow the curve of bail 30 to encourage the continuation of a rolling motion.

The construction shown in the drawings and described immediately above is very efficient at penetrating a bottom, even if formed of a hard-packed or scoured sand. In order to firmly set the anchor against movement once the hooks have penetrated into the bottom, flukes are provided. Flukes 32, 33 and 34 are "nested" and welded into the concavity formed by hooks 18, 19 and 20 on the rear ends of runners 11, 12 and 13, respectively. Flukes 35 and 36 are welded to the top surface of hooks 22 and 23, respectively, of the front end of runners 11 and 13. In each case the flukes 32–35 are preferably no wider than hooks 18–20, 22, 23 so as to minimize resistence to downward as opposed to forward movement. Each of the flukes 32–36 present a flat surface to the direction of anchor travel. Whereas the round surfaces of runners 11, 12 and 13 present a relatively hydrodynamic shape around which sand and other bottom material can easily move, the flat surfaces of flukes 32–36 present drag-inducing surfaces around which bottom material cannot easily move. Therefore, as the points 18A–20A and 22A, 23A are penetrating the bottom material, forward movement of the anchor is restricted by the drag induced by flukes 32–36.

Figure 4:
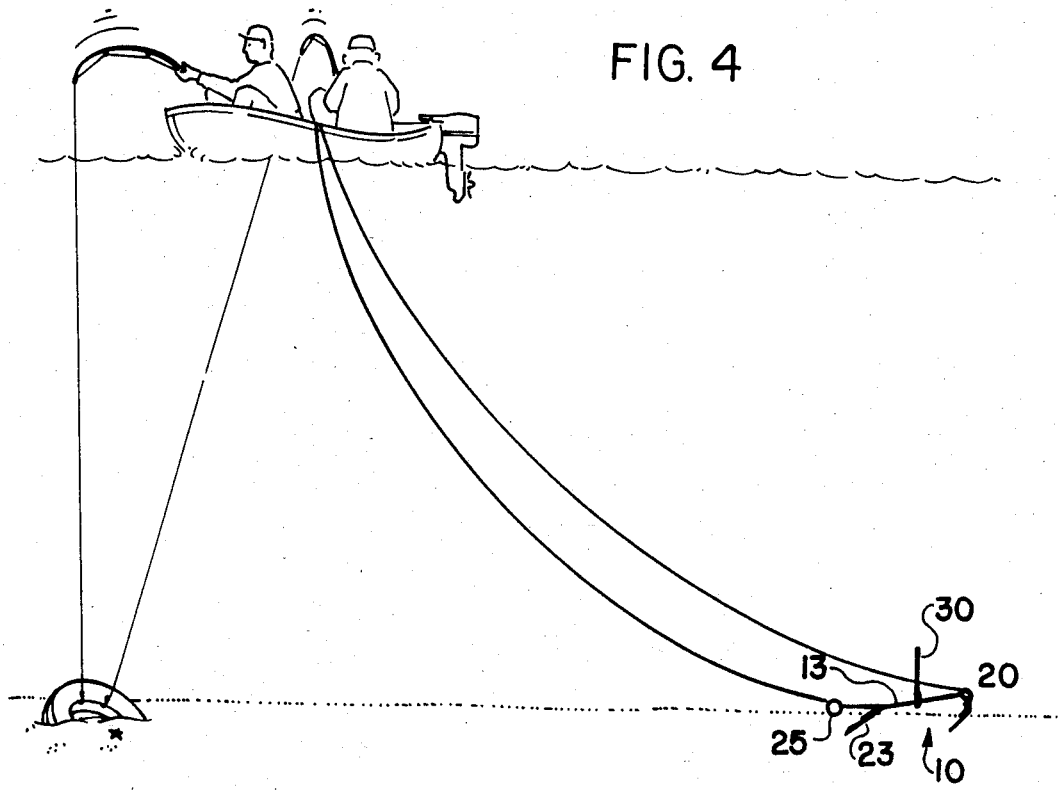
FIG. 4 is an environmental view showing the anchor in use.
Figure 5:
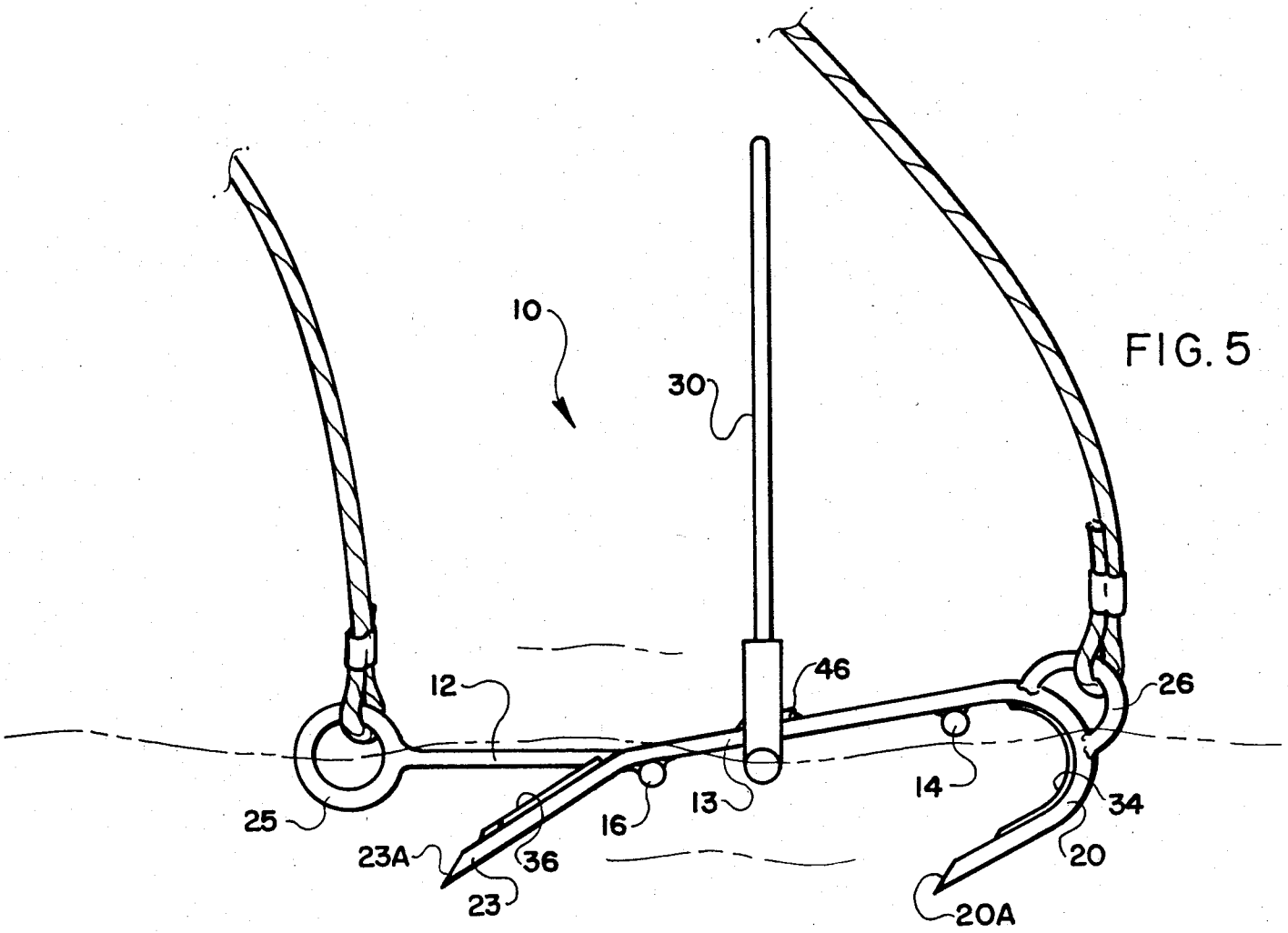
FIG. 5 is a side elevational view of the anchor in use.

Referring now to FIGS. 4 and 5, when properly set all of hooks 22 and 23 and most of hooks 18, 19 and 20 are set into the bottom material. Rings 25 and 26 are set high enough on the anchor so that they remain exposed above the bottom material when the anchor 10 is properly set. Rings 20 and 25 make it possible for the anchor 10 to be pulled in either direction. Because of the relatively little actual surface area presented by the hooks 18–20 and 22 and 23, the possibility of fouling in minimized. Nevertheless, should fouling occur, the anchor 10 can be pulled in either direction as required.

The anchor 10 is preferably formed of a salt water resistent material such as type 304 stainless steel. Type 316 stainless steel would also be a suitable material. Runners 18, 19 and 20 are preferably formed of $\frac{3}{8}$ inch (1 cm) round bar. Tie bars 14 and 16 are formed of $\frac{3}{8}$ inch (1 cm) round bar, while tie bar 15 is constructed of 3/16 inch (0.5 cm) round bar. The bail is constructed of $\frac{1}{4}$ inch (0.64 cm) round bar. Flukes 32–36 are constructed of $\frac{1}{8}$ inch (0.32 cm) thick by $\frac{1}{2}$ inch (1.28 cm) wide flat bar.

Of course, the particular number of runners and tie bars are dependant primarily upon the size of anchor needed and can be easily varied to take into account anticipated boat size, current speed or bottom material characteristics.

A boat anchor is described above. Various details of the invention may be changed without departing from its scope. Furthermore, the foregoing description of the preferred embodiment of a boat anchor according to the present invention is provided for the purpose of illustration only and not for the purpose of limitation—the invention being defined by the claims.

I claim:

1. A boat anchor for holding in bottom material such as sand and mud, and comprising:

(a) first and second elongate, longitudinally extending runners, a one end of each of said runners defining a rear spike and the other one of each of said runners defining a front spike whereby substantially translational movement of the runners relative to the bottom drives the front and rear spikes into the bottom material, said rear spikes defining an acute angle and said front spikes defining an obtuse angle relative to the runner intermediate said rear and front spikes;

(b) at least one transversely extending tie bar to which said first and second runners are secured in spaced-apart registration with each other;

(c) means for attaching the anchor to a line.

2. An anchor according to claim 1, and including a plurality of spaced-apart tie bars secured to said runners at intervals along the length thereof.

3. An anchor according to claim 2, and including a bail attached thereto for rolling said anchor onto its functioning position with its spikes directed into the bottom material, said bail comprising an arcuate, substantially semicircular bar having opposing ends attached to opposite sides of said anchor.

4. An anchor according to claim 3, wherein said bail is mounted on said runners for pivotal movement thereon.

5. An anchor according to claim 1, wherein said anchor includes a third elongate runner secured to said tie bar intermediate said first and said second runners.

6. An anchor according to claim 5, wherein said means for attaching said anchor to a line comprises a front ring cooperating with a front end of said anchor and a rear ring cooperating with a rear end of said anchor, each ring adapted to receive a separate line whereby if the anchor fouls in bottom material it can be pulled in either or both of two directions as necessary to free it.

7. An anchor according to claim 6, wherein said third runner defines said front ring on a front end thereof.

8. An anchor according to claim 5, 6, or 7, and including flukes positioned on portions of at least some of said runners, said flukes comprising drag resisting plates conformed to the shape of the portion of the runner on which it is positioned and having a side defining a flat surface transverse to the runner for presenting the flat surface side in the direction of anchor movement to resist movement of the anchor through the bottom material.

9. An anchor according to claim 6, wherein a said fluke is positioned in a concavity of the acutely angled rear spike of each of the first, second and third runners.

10. An anchor according to claim 8, wherein a said fluke is positioned on the upper surface of said obtusely angled spike of each of said first and second runners.

11. A boat anchor for holding in bottom material such as sand and mud, and comprising:

(a) first, second and third elongate, longitudinally extending runners, a one end of each of said runners defining an acutely angled rear spike and the other end of at least two of said runners defining an obtusely angled front spike whereby substantially translational movement of the runners relative to the bottom drives the front and rear spikes into the bottom material, said rear spikes defining an acute angle and said front spikes defining an obtuse angle relative to the runner intermediate said rear and front spikes;

(b) a plurality of transversely extending tie bars to which said first and second runners are secured in spaced-apart registration with each other;

(c) means for attaching the anchor to a line and comprising a front ring cooperating with a front end of one of said runners and a rear ring cooperating with a rear end of one of said runners, each ring adapted to receive a separate line whereby if the anchor fouls in bottom material it can be pulled in either or both of two directions as necessary to free it; and (d) including flukes positioned on portions of at least some of said runners, said flukes comprising drag resisting plates conformed to the shape of the portion of the runner on which it is positioned and having a side defining a flat surface transverse to the runner for presenting the flat surface side in the direction of anchor movement to resist movement of the anchor through the bottom material.

* * * * *